United States Patent [19]

Jensen

[11] Patent Number: 4,876,841

[45] Date of Patent: Oct. 31, 1989

[54] METHOD AND MEANS FOR SECURING PALLETIZED MATERIALS

[76] Inventor: Janet R. Jensen, 107 Northwest First St., (Box 36), Melcher-Dallas, Iowa 50163

[21] Appl. No.: 197,670

[22] Filed: May 23, 1988

[51] Int. Cl.[4] ..... B65B 13/02

[52] U.S. Cl. ..... 53/399; 53/441; 53/461; 108/55.1; 206/597; 206/264; 269/328

[58] Field of Search ..... 269/328; 108/55.1, 56; 206/264, 428, 597, 600; 53/339, 441, 461

[56] References Cited

U.S. PATENT DOCUMENTS

| | | | |
|---|---|---|---|
| 1,966,893 | 7/1934 | Harris | 294/67 |
| 3,088,619 | 5/1963 | Boucher | 220/1.5 |
| 3,185,197 | 5/1965 | Spiro et al. | 150/52 |
| 3,185,197 | 5/1965 | Spiro et al. | 150/52 |
| 3,425,472 | 2/1969 | Marino | 150/50 |
| 3,933,154 | 1/1976 | Cabansag | 269/328 |
| 3,949,929 | 4/1976 | Kupersmit | 229/23.6 |
| 4,136,501 | 1/1979 | Connolly | 53/461 |
| 4,208,457 | 6/1980 | Kelly et al. | 428/107 |
| 4,332,326 | 6/1982 | Kelly et al. | 206/497 |
| 4,484,571 | 11/1984 | Velazquez | 269/328 |

FOREIGN PATENT DOCUMENTS

| | | | |
|---|---|---|---|
| 2522113 | 11/1976 | Fed. Rep. of Germany | 206/597 |
| 2651929 | 5/1978 | Fed. Rep. of Germany . | |

*Primary Examiner*—W. Donald Bray

*Attorney, Agent, or Firm*—Zarley, McKee, Thomte, Voorhees & Sease

[57] ABSTRACT

The present invention relates to a combination including a pallet having a horizontal supporting surface. A stack of objects is piled upon the pallet, and a flexible sheet member is wrapped around the perimeter of the stack and secured together at its opposite ends for holding the various objects in the stack against falling during the transporting of the pallet.

5 Claims, 1 Drawing Sheet

METHOD AND MEANS FOR SECURING PALLETIZED MATERIALS

BACKGROUND OF THE INVENTION

This invention relates to a method and means for securing palletized materials.

Pallets are used extensively for supporting goods and containers for goods in a storage facility such as a warehouse. One problem often encountered with palletized materials, particularly when a large number of irregularly shaped containers are supported by a pallet, is the tendency of the palletized materials to fall off of the pallet during transporting.

This is a particularly difficult problem in grocery stores. The various boxes and containers of the groceries in the storage room of the grocery store are often stored on pallets. At night, the pallets are moved from the storage room into the grocery store where the shelves of the grocery store are restocked.

One problem often encountered in moving palletized groceries is the spillage occurring when the boxes fall off of the pallets during transporting. This often results in losing a big part of the materials stored on a pallet due to breakage, contamination, etc. There are several reasons why this occurs.

Often the pallets are stacked in a haphazard manner. Time is of the essence during the evening stocking period at a grocery store and the materials are often placed on the pallet quickly in a haphazard manner.

Furthermore, the boxes are usually of different sizes, shapes and weight, and sometimes the boxes have been opened or cut down, thereby resulting in uneven sides which are not conducive to stacking. Sometimes a box will collapse causing the entire stack to fall.

Furthermore, while moving the pallet it is easy for the boxes or containers to fall off of the pallet while rounding a corner or during quick starts or stops. Sometimes the corner of the pallet will be caught on a door or counter during transporting of the pallet and result in the stack being knocked off of the pallet.

The fork for lifting the pallet sometimes lifts the center of the pallet slightly more than the outside, thereby resulting in the outside edges of the pallet tilting outwardly and resulting in spillage of the boxes.

The problems which result from spillage include lost time and often damaged goods, such as dented cans or broken glass. Time is also lost during the clean-up resulting from a spilled pallet. Sometimes damage results to the shelves and counters within the grocery store.

Therefore, a primary object of the present invention is the provision of an improved method and means for securing palletized materials.

A further object of the present invention is the provision of a method and means for securing palletized materials which permits the materials to be moved while at the same time minimizing spillage or damage to the materials on the pallet.

A further object of the present invention is the provision of a method and means which reduces the time now necessary for restacking spilled palletized materials.

A further object of the present invention is the provision of a method and means which reduces the amount of damage, contaminated or broken goods which result from spillage from the pallet.

A further object of the present invention is the provision of a method and means which minimizes the damage to the shelves and other facilities which result from spillage of materials from the pallet.

A further object of the present invention is the provision of a method and means for securing palletized materials which is efficient in operation, simple in construction, and durable in use.

SUMMARY OF THE INVENTION

The present invention utilizes an elongated flexible sheet member having a plurality of securing straps at the opposite ends thereof. The sheet member is wrapped around the palletized materials and the straps are secured together so as to contain the palletized materials and prevent them from falling.

An additional strap may be attached to the upper edge of the sheet member and extends over the top of the stack of palletized materials so as to prevent the sheet member from creeping downwardly relative to the stack of palletized materials.

The straps are preferably connected to one another by virtue of a raise of hooks and eyes which adhere to one another upon contact. These hook-eye securing means are commercially available under the trademark "VELCRO". They have the advantage of providing quick attachment and detachment so as to minimize the time necessary to utilize the securing means of the present invention.

DETAILED DESCRIPTION OF THE PREFERRED EMBODIMENT

Figure 1:
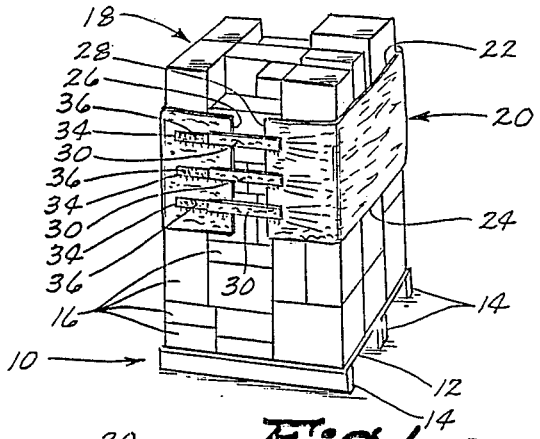
FIG. 1 is a perspective view of a stack of palletized materials having the securing means of the present invention positioned in place thereon.

Referring to the drawings, the numeral 10 generally designates a pallet having a horizontal platform portion 12 and a plurality of elongated upstanding ribs 14 which support platform 12 in spaced relation above the supporting surface. Supported on platform 12 are a plurality of boxes or containers designated generally by the numeral 16 which are piled up on one another to form a stack 18. The containers 16 shown in stack 18 are irregular in shape, and the particular drawing of FIG. 1 is meant to be illustrative of the typical stack of containers which might be found, for example, in a grocery store. However, the particular shapes and sizes of the containers can vary without detracting from the invention.

Surrounding the stack 18 of container 16 is a flexible sheet member 20 having an upper edge 22, a lower edge 24 and opposite ends 26–28. Sheet member 20 may be made of plastic, canvas, or other flexible material. It is not necessary that sheet member 20 have a width between upper and lower edges 22–24 sufficient to cover the entire height of stack 18. As can be seen in FIG. 1, the height between edges 22–24 is between approximately one-third and one-half of the height of the entire stack 18.

Figure 2:
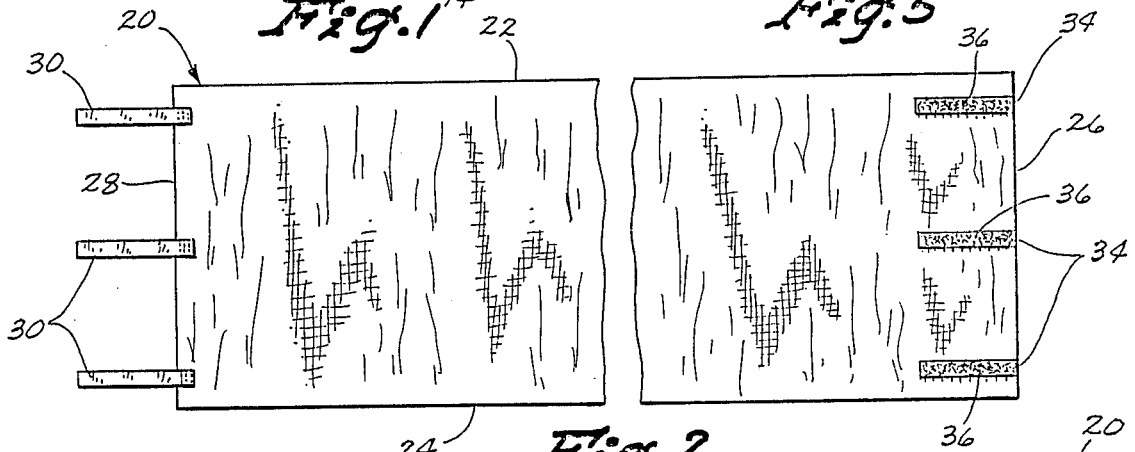
FIG. 2 is a plan view of the flexible sheet member used in the present invention.
Figure 3:
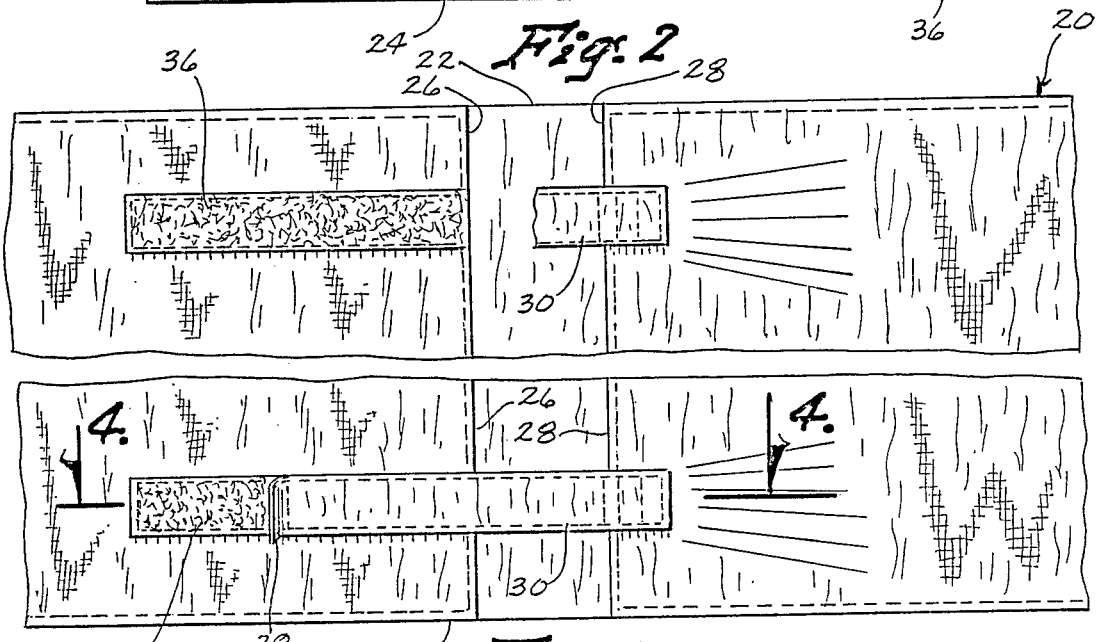
FIG. 3 is an enlarged detail view showing the securing straps of the present invention.

Attached to end 28 of the sheet member 20 are three securing straps 30. One end of each securing strap 30 is sewn or otherwise permanently secured to end 28 of sheet member 20. As can be seen in FIGS. 2 and 3, one face of each strap 30 is provided with an elongated strip containing a plurality of hook members 32.

Operatively secured by sewing or other means to the other end 26 of sheet member 20 are three complimentary securing straps 34 each of which is provided with an elongated surface containing a plurality of eye members 36 which are adapted to retentively engage the hook members of surface 32 upon contact. These hook and eye members 32–36 are commercially available under the trademark "VELCRO".

Figure 4:
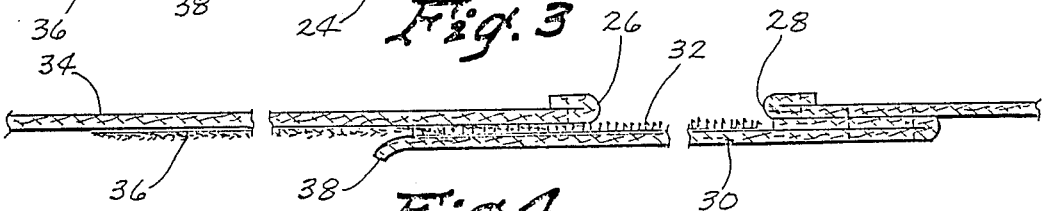
FIG. 4 is a sectional view taken along line 4—4 of FIG. 3.

As can be seen in FIG. 4, the surface 32 of hook members on securing strap 30 terminates short of the end of strap 30 so that a grasping portion 38 is free for grasping by the operator to part members 30–34 and separate the straps from one another.

As can be seen in FIG. 1, the straps 30 have been pulled and stretched to the point where they are in engagement with the complimentary straps 34, and the hook and eye surfaces 32–36 cause the straps to be detachably secured together. In this position sheet member 20 surrounds and tentatively engages the container 16 in stack 18 and prevents them from falling during transporting.

In this arrangement it is possible to transport the pallet 10 with the stack 18 thereon in such a manner that the boxes or container 16 do not fall off of the pallet.

It is a simple matter to use the wrap 20. The operator approaches the stack 18 and tucks one corner of end 26 of the wrap between two of the boxes 16. The operator then walks around the stack 18 so as to carry the opposite end 28 of wrap 20 completely around the stack and to place it adjacent the end 26. The straps 30 are then quickly attached to the straps 34 and in this position the wrap 20 encircles and retains the containers 16 so as to hold them against falling by gravity during transporting.

Figure 5:
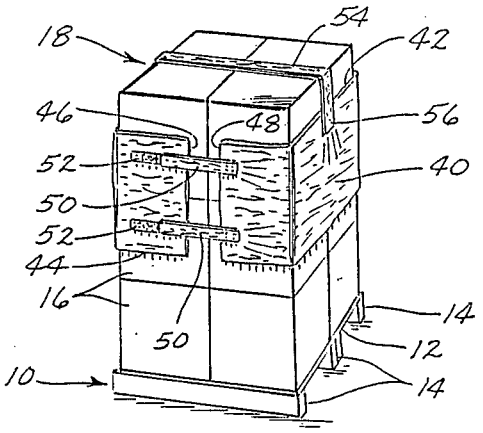
FIG. 5 is a perspective view of a modified form of the present invention.

Referring to FIG. 5, a modified form of the invention is shown for holding the stack 18 of container 16 in place. The modified form of the wrap is designated by the numeral 40 and includes an upper edge 42, a lower edge 44 and end edges 46–48. Wrap 40 is provided with two straps 50 attached to end 48 and of similar construction to straps 30 shown in FIGS. 2–4. Wrap 40 is also provided with two complimentary straps 52 which are identical to the straps 34 shown in FIGS. 2–4.

A top strap 54 has one end 56 detachably secured to the upper edge 42 of wrap 40, and extends over the top of stack 18 and downwardly where it is detachably secured to the opposite side of wrap 56. The means for detachably securing the strap 54 to wrap 40 can include a hook and eye arrangement similar to that shown for straps 50–52. The purpose of strap 54 is to prevent the wrap 40 from creeping downwardly with respect to stack 18 during the transporting of the pallet. Thus, it can be seen that the device accomplishes at least all of its stated objectives.

What is claimed is:

1. A combination comprising:

a pallet having a horizontal supporting surface;

a plurality of irregularly shaped and sized containers having groceries therein, said containers being piled on top of said supporting surface and piled upon one another to form a stack of said containers, said stack having a perimeter and extending upwardly from said supporting surface to a stack top;

wrapping means extending around said perimeter of said stack and engaging at least a portion of said plurality of said containers to prevent said containers and said groceries from falling from said stack, said wrapping means comprising an elongated flexible sheet member, at least first and second elongated straps, and at least first and second elongated complimentary straps;

said sheet member having an upper horizontal edge, a lower horizontal edge, a first end and a second end, said sheet member having a vertical height between said upper and lower horizontal edges which is at least one half of the height of said stack of containers;

said first and second straps having first ends attached to said first end of said sheet member in vertical spaced relation to one another, said first and second straps also having second ends adjacent said second end of said sheet member;

said first and second complimentary straps extending horizontally and being attached to said second end of said sheet member in vertical spaced relation with one another;

each of said first and second straps having an elongated securing member attached to said second end thereof;

each of said first and second complimentary straps having a complimentary securing member attached thereto;

said first and second complimentary securing members being detachably retentively engageable with said first and second securing members so as to permit said first and second straps to be detachably secured to said first and second complimentary straps, whereby said wrapping means can be detachably secured in snug surrounding relation to said stack of said containers of groceries.

2. A combination according to claim 1 wherein said first and second securing members comprise a plurality of looping members, and said first and second complimentary securing members comprise a plurality of hooking members adapted to detachably adhere to said looping members on contact therewith.

3. A combination according to claim 1 and further comprising an elongated top strap having first and second ends, said first end being detachably secured to said wrapping means, at a first point, said top strap extending from said first point over said stack top, said second end being detachably secured to said wrapping means at a second point, whereby said top strap will hold said wrapping means against downward movement relative to said stack.

4. A method for moving a plurality of grocery containers resting on the upper horizontal surface of a pallet, said plurality of grocery containers having groceries therein and having a plurality of irregular shapes and sizes, said containers being stacked upon one another into a stack having a stack perimeter and a stack top, said method comprising:

wrapping a flexible sheet member around said perimeter of said stack, said sheet member having a first end and a second end adjacent one another when wrapped around said stack, said sheet member having upper and lower edges spaced apart from one another a vertical distance which is at least one-half the height of said stack, said sheet member having at least first and second elongated straps which each have a first end attached to said first end of said sheet member, said first and second straps each having second ends;

pulling said second ends of said first and second straps toward said second end of said sheet member so as to cause said sheet member to snugly embrace said stack;

detachably securing said second ends of said first and second straps to said second end of said sheet member, whereby said sheet member and said first and second straps together will surround said stack and hold said plurality of containers against falling off of said pallet during transportation of said pallet;

transporting said pallet with said stack of grocery containers and groceries thereon to a new location;

detaching said second ends of said first and second straps from said second end of said sheet member; and said second end of said sheet member; and removing said containers and said groceries from said stack and from said pallet.

5. A method according to claim 4 and further comprising extending a top strap over said top of said stack and attaching the opposite ends of said top strap to said flexible sheet member before transporting said pallet, whereby said top strap will hold said flexible sheet member against downward movement relative to said stack during transporting.

* * * * *